US006170226B1

(12) United States Patent
Chang

(10) Patent No.: US 6,170,226 B1
(45) Date of Patent: Jan. 9, 2001

(54) CAPSULE FILLING APPARATUS

(76) Inventor: William Chang, 7F-3, No.92, Sec.1, Yuang-Ping North Road, Taipei (TW)

( * ) Notice: Under 35 U.S.C. 154(b), the term of this patent shall be extended for 0 days.

(21) Appl. No.: 09/116,302

(22) Filed: Jul. 15, 1998

(51) Int. Cl.[7] ..... B65B 1/04; B65B 57/00
(52) U.S. Cl. ..... 53/64; 53/253; 53/282; 53/900
(58) Field of Search ..... 53/64, 253, 282, 53/391, 560, 900

(56) References Cited

U.S. PATENT DOCUMENTS

| | | | | |
|---|---|---|---|---|
| 3,531,909 | * | 10/1970 | Edelbalk | 53/64 |
| 4,802,323 | * | 2/1989 | Garris | 53/900 |
| 5,081,822 | * | 1/1992 | Boyd | 53/900 |
| 5,495,702 | * | 3/1996 | Ko | 53/900 |

* cited by examiner

*Primary Examiner*—John Sipos
(74) *Attorney, Agent, or Firm*—Pro-Techtor International Services

(57) ABSTRACT

Disclosed is a capsule filling apparatus mainly including a capsule positioning mechanism, a powder filling mechanism, and an assembling mechanism. Both the capsule position and powder filling mechanisms include a capsule holding means formed form an upper and a lower part. The lower part of the capsule holding means is controlled to move by a motor and coupler, clutch, sensing plate mounted on the shaft of the motor. A suction hole is formed at the bottom of each capsule holding hole on the lower part of the capsule holding means to communicate with an external vacuum source. A locating means is provided below a seat of the lower part of the capsule holding means in the capsule positioning mechanism. The powder filling mechanism includes a powder tank. An air cylinder drives the powder tank to move to or away from the capsule holding means by eccentrically connecting a piston shaft to a lower outer side of the powder tank.

1 Claim, 6 Drawing Sheets

CAPSULE FILLING APPARATUS

BACKGROUND OF THE INVENTION

The present invention relates to a capsule filling apparatus, and more particularly to a capsule filling apparatus which can be precisely controlled to prevent insufficient or excessive filling of powder into the capsules.

Generally, a capsule includes a hollow container and a cap which has an inner diameter slightly larger than an outer diameter of the container. Different types and doses of medicine powder may be dispensed and filled into the capsule with a capsule filling apparatus.

When using a conventional capsule filling apparatus to fill capsules, the caps of the capsules must first be separated from the containers and medicine powder is filled into the containers with a manually controlled powder filling mechanism. More specifically, the containers with the caps temporarily removed are manually pulled to a filling area for filling medicine powder into the containers. In the conventional capsule filling apparatus, capsules to be filled are positioned on capsule holding means on which multiple rows of holes are arranged in rows side by side to each contain an empty capsule waiting for filling with powder by an operator. The operator tends to fill insufficient or excessive powder into different capsules due to tiredness caused by operation for a long time, making the filled capsules defective products containing insufficient or excessive dosage of medicine powder. This is, of course, undesirable and not acceptable.

FIG. 1 illustrates a conventional capsule filling apparatus 10 in which a capsule positioning mechanism 11, a powder filling mechanism 12, and an assembling mechanism 13 are included. Disc-shaped capsule holding means 14, 15 are provided in the apparatus 10 corresponding to the capsule positioning mechanism 11 and the powder filling mechanism 12, respectively. A plurality of holes 141, 151 are regularly arranged in multiple rows extending from inner to outer side on the capsule holding means 14, 15, respectively, to each receive an empty capsule therein. The capsule positioning mechanism 11 positions empty capsules into the holes 141 on the capsule holding means 14. Vacuum suction is used to suck lower containers of the capsules from the upper caps. Then, the capsule holding means 14 is moved to the powder filling mechanism 12, so that medicine powder is filled into the lower containers. FIG. 2 schematically illustrates steps A to D included in the conventional capsule filling apparatus to fill the capsules. In step A of FIG. 2, the capsule positioning mechanism 11 sends empty capsules 16 into holes 141 on the capsule holding means 14 which is formed from an upper part 142 and a lower part 143. A portion of each hole 141 located in the upper part 142 of the capsule holding means 14 has a diameter larger than that of another portion 144 of each hole 141 located in the lower part 143 of the capsule holding means 14. When the empty capsules 16 are positioned in the holes 14, the caps 161 of the capsules having larger diameter are located in the large-diameter upper holes 141 while the containers of the capsules 16 having smaller diameter are located in the small-diameter lower holes 144. A suction hole 145 having a reduced diameter smaller than that of the lower hole 144 is formed at a bottom of each lower hole 144. Suction is provided by a vacuum source (not shown) to suck the containers of the capsules 16 via the suction holes 145, so that the containers of the capsules are sucked to a lower position in the lower holes 144, as shown in the Step B. At this point, the capsule holding means 14 is moved to the powder filling mechanism 12 and will be referred to as capsule holding means 15 to conveniently distinguish it from the capsule holding means 14 in the capsule positioning mechanism 11. In the powder filling mechanism 12, the upper part 152 (originally 142) of the capsule holding means 15 is removed from the lower part 153 (originally 143) and powder 121 is filled into the empty containers of the capsules 16 in the small-diameter lower holes 154 (originally 144) by the power filling mechanism 12, as shown in the Step C. The lower part 153 and the upper part 152 are then moved to the assembling mechanism 13 to be assembled again, as shown in the Step D, so that the containers of the capsules 16 filled with medicine powder are covered by the caps 161.

In the above-described conventional capsule filling apparatus 10, the capsule holding means 15 is manually controlled through a foot switch 17, as shown in FIG. 1, to rotate row by row in an intermittent manner. And, the powder filling mechanism 12 is manually pulled to locate above the capsule holding means 15 to fill powder 121 into individual capsules. As a result, the capsule holding means 15 is not always precisely located below the powder filling mechanism 12 to permit each capsule to receive accurate dosage of medicine powder. Moreover, the operator tends to fill incorrect amount of powder into the capsules due to tiredness caused by long time of work. Defective capsules with insufficient or excessive dosage are therefore frequently produced.

SUMMARY OF THE INVENTION

It is therefore a primary object of the present invention to provide a capsule filling apparatus in which a clutch is used to cooperate with vacuum suction to more accurately control the separation of the containers of capsules from the caps in the capsule holding means, and the clutch also cooperates with a sensor to control revolution and starting point of the capsule holding means to more precisely control dosage into each main capsule. The drawback of insufficient or excessive dosage caused by manual filling of powder into the capsules can therefore be avoided to ensure uniform dosage in the produced medicine capsules.

BRIEF DESCRIPTION OF THE DRAWINGS

The novelty and other features of the present invention will become apparent by referring to the following detailed description of the preferred embodiments and the accompanying drawings, wherein.

DETAILED DESCRIPTION OF THE PREFERRED EMBODIMENTS

Figure 1:
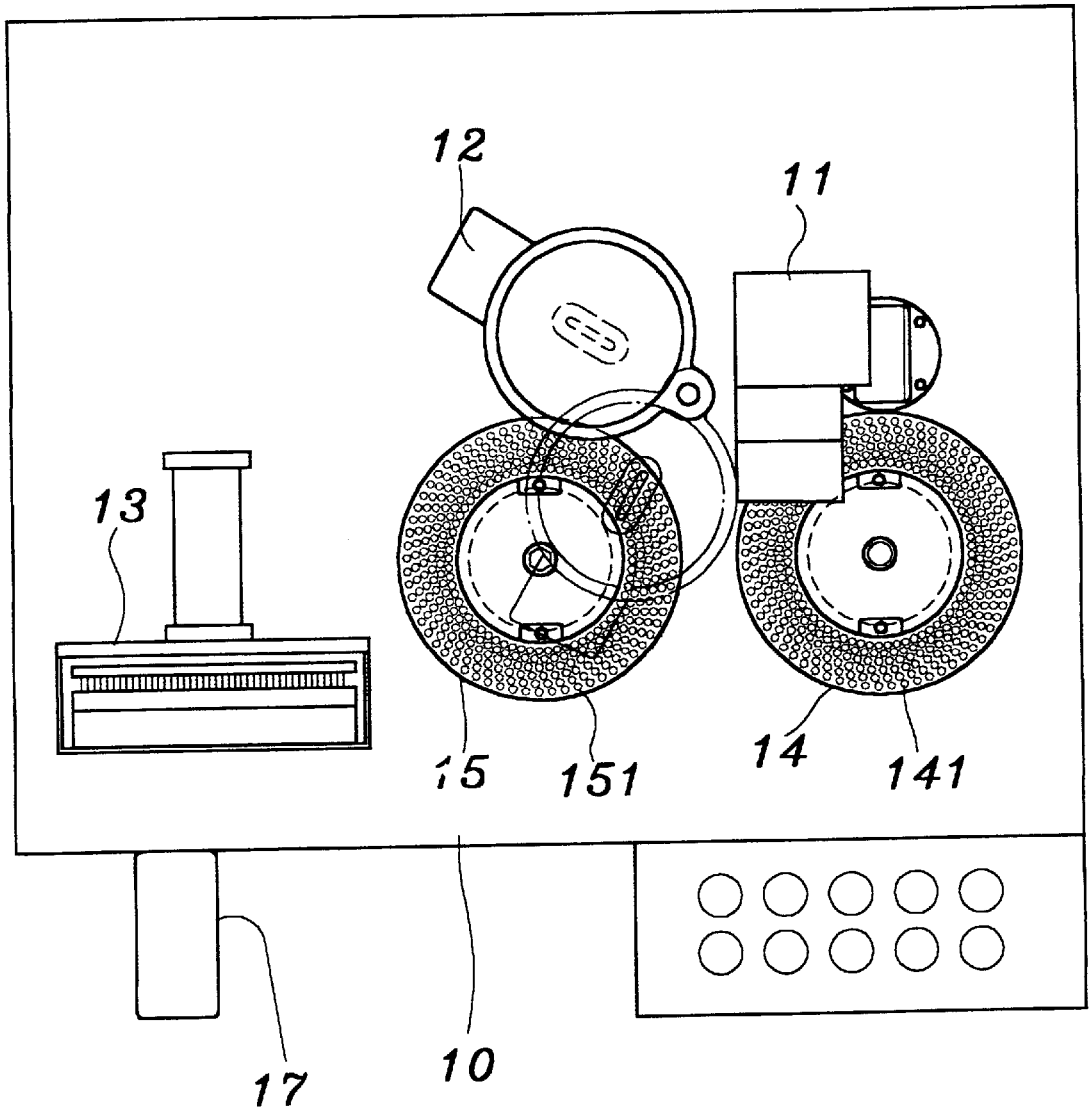
PRIOR ART FIG. 1
FIG. 1 is a schematic plan view of a conventional capsule filling apparatus.
Figure 2:
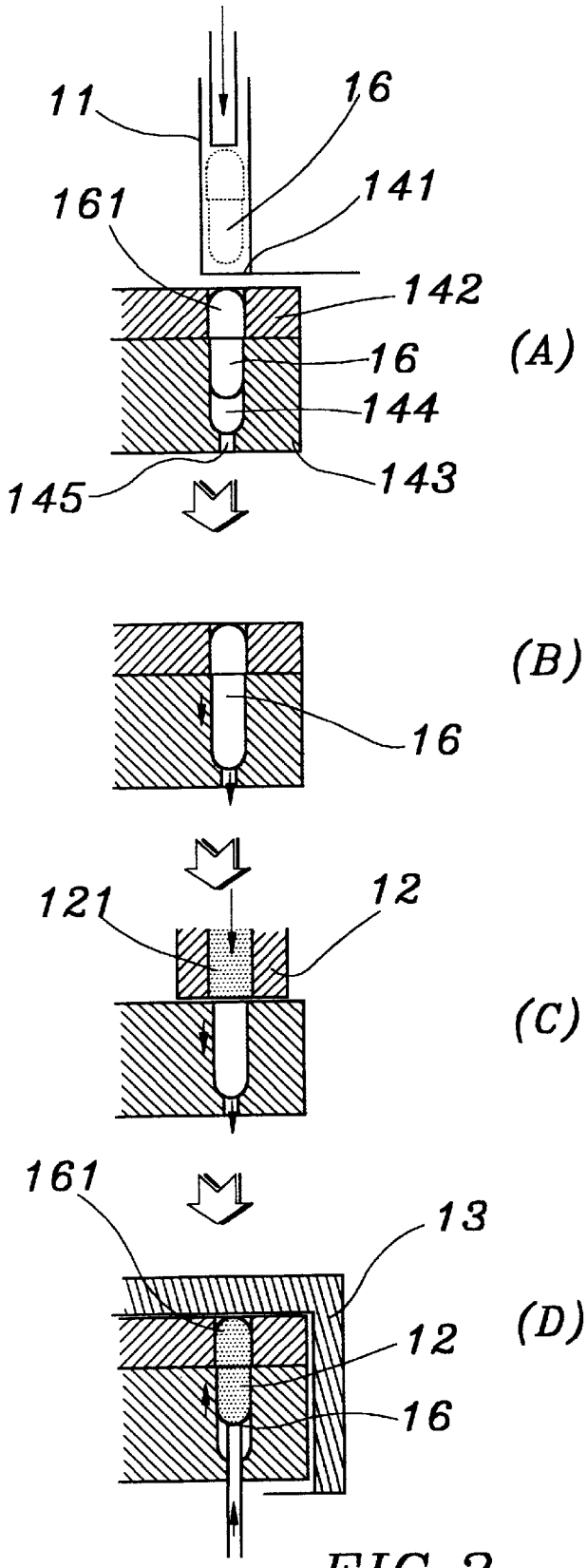
FIG. 2 illustrates the capsule filling steps adopted in the conventional capsule filling apparatus of FIG. 1.
Figure 3:
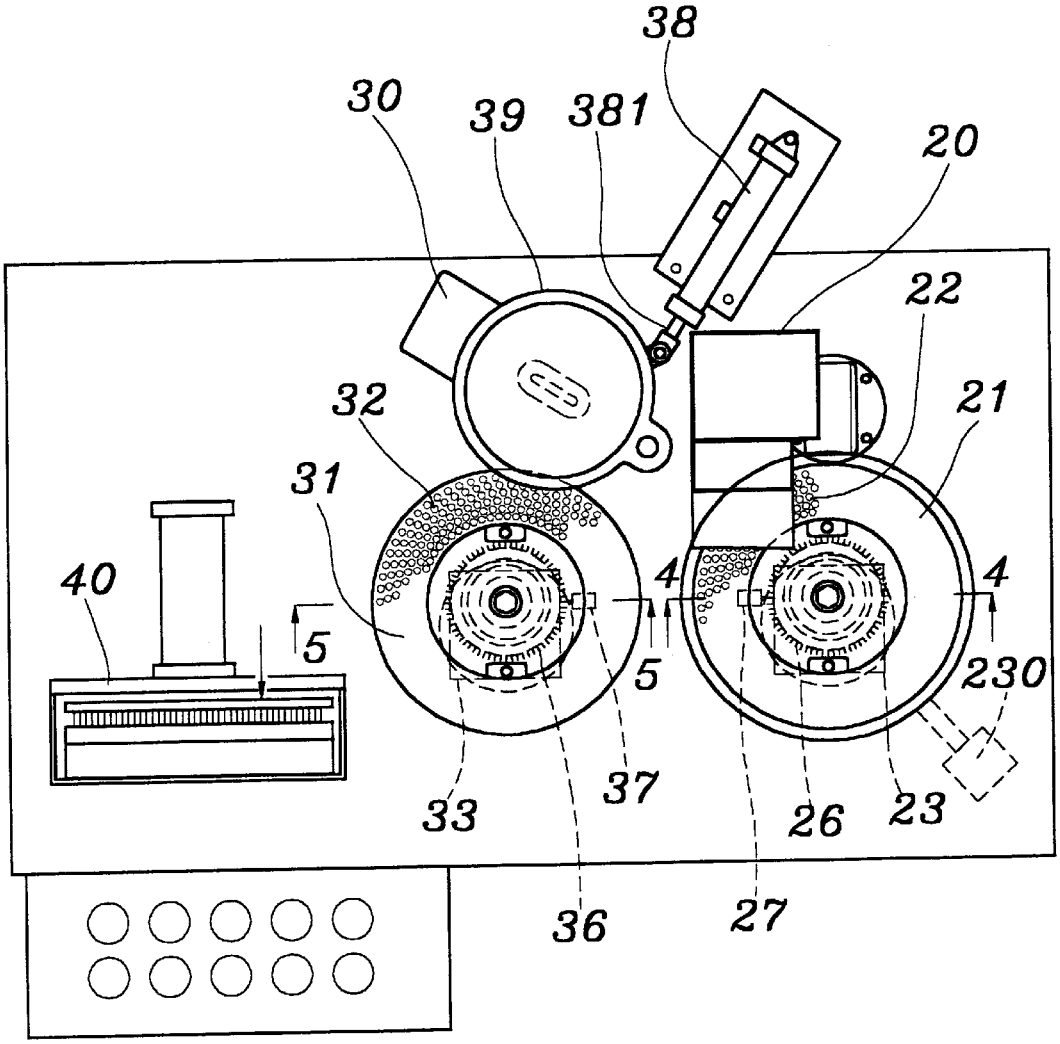
FIG. 3 is a plan view showing the structure of a capsule filling apparatus according to a preferred embodiment of the present invention.

Please refer to FIG. 3 which is a schematic plan view of a capsule filling apparatus according to a preferred embodiment of the present invention. The capsule filling apparatus includes a capsule positioning mechanism 20, a powder filling mechanism 30, and an assembling mechanism 40. Two identical capsule holding means 21, 31 are correspondingly located below the capsule positioning mechanism 20 and the powder filling mechanism 30, respectively. A plurality of capsule holding holes 22, 32 are arranged on the capsule holding means 21, 31, respectively, in rows extending from inner to outer side of the capsule holding means 21, 31.

Figure 4:
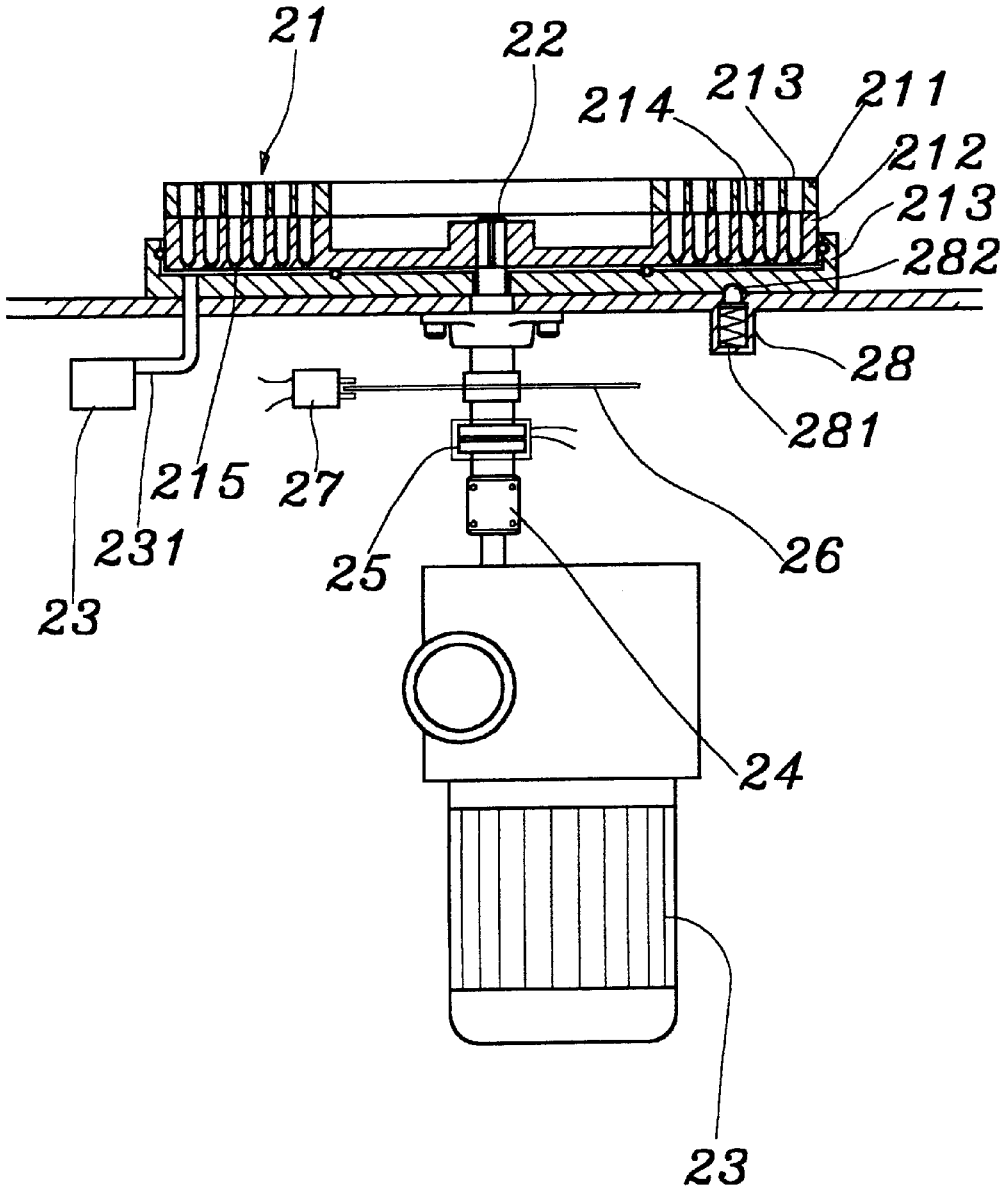
FIG. 4 is a fragmentary cross section of the present invention taken on line 4—4 of FIG. 3.

Please now refer to FIGS. 3 and 4 at the same time. The capsule holding means 21 includes an upper part 211 and a lower part 212. The upper part 211 is removably disposed on the lower part 212 while the lower part 212 is located in a seat 213. A shaft 214 upward extends through a center of the seat 213 to engage with the lower part 212, so as to bring the lower part 212 to rotate along with the shaft 214. Each of the capsule holding holes 22 on the capsule holding means 21 also include a large-diameter upper hole 221 and a small-diameter lower hole 222 respectively formed in the upper part 211 and the lower part 212 of the capsule holding means 21. Each small-diameter lower hole 222 of the capsule holding hole 22 is provided at a lower end with a suction hole 215. An external vacuum pump 230 having a vacuum pipe 231 connected to a bottom of the lower part 212 of the capsule holding means 21 is used to vacuumize bottom portions of the small-diameter lower holes 222 of the capsule holding holes 22, so that lower containers of capsules located in the lower holes 222 are sucked downward to separate from upper caps of capsules located in the upper holes 221.

The shaft 214 is connected to and driven by a motor 23 disposed below the capsule positioning mechanism 20. The motor 23 is controlled by a driving system including a coupler 24, an electromagnetic clutch 25, and a sensing plate 26 mounted on a lower portion of the shaft 214, as well as a sensor 27 provided near outer periphery of the sensing plate 26 at a predetermined position. A plurality of sensing points are provided on the sensing plate 26 according to numbers of the capsule holding holes 22 on the capsule holding means 21. Meanwhile, a locating means 28 is arranged below the seat 213 according to numbers of the capsule holding holes 22 on the capsule holding means 21. In a preferred embodiment shown in FIG. 4, the locating means 28 includes a spring 281 which presses a locating rod 282 against a recess provided at a bottom surface of the seat 213.

Figure 5:
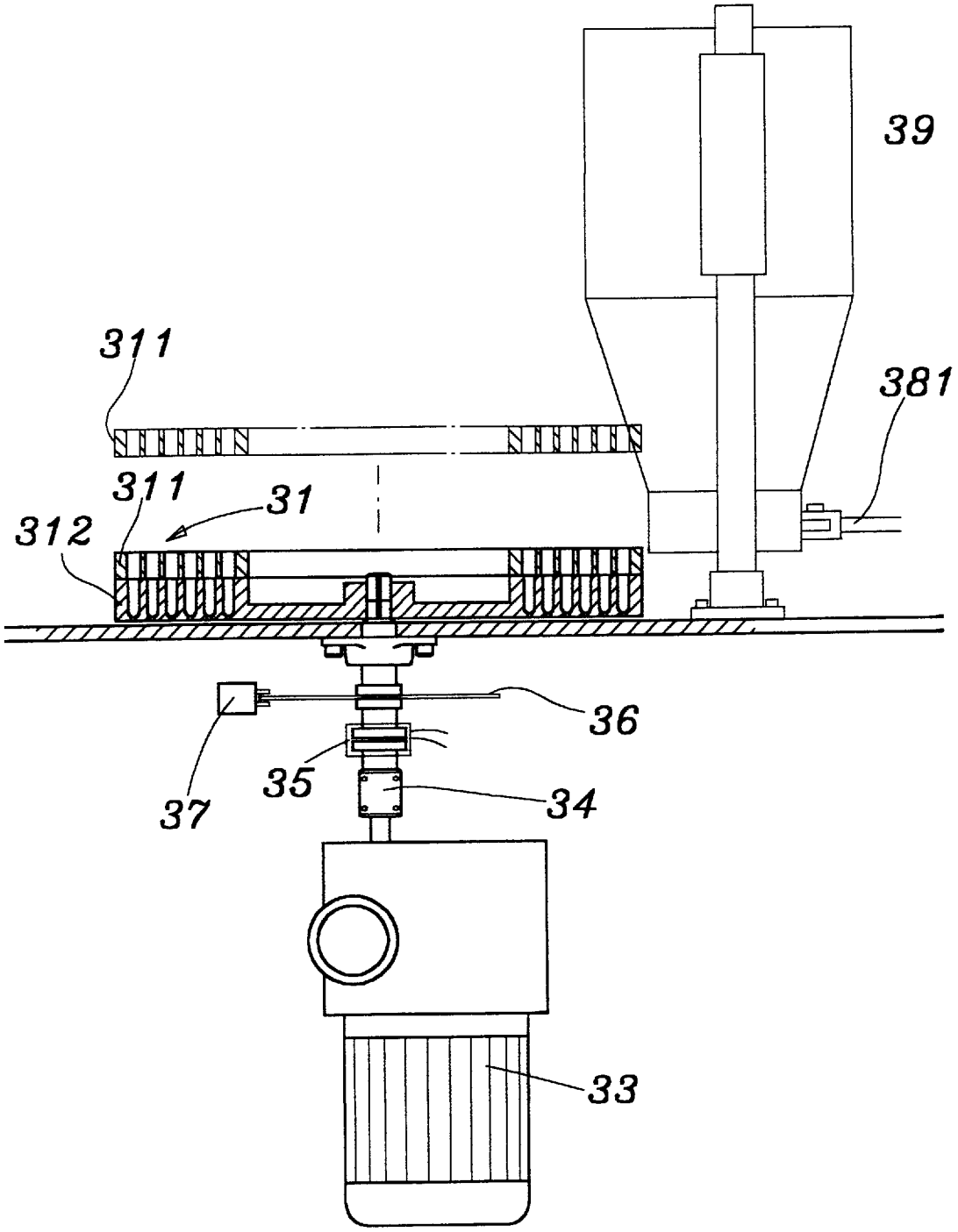
FIG. 5 is another fragmentary cross section of the present invention taken on line 5—5 of FIG. 3.

Now, please refer to FIGS. 3 and 5 at the same time. The capsule holding means 31 disposed below the powder filling mechanism 30 is identical to the capsule holding means 21 and includes an upper part 311 and a lower part 312. Each of the capsule holding holes 32 on the capsule holding means 31 also include a large-diameter upper hole 321 and a small-diameter lower hole 322 respectively formed in the upper part 311 and the lower part 312 of the capsule holding means 31. The lower part 312 is associated with a shaft 314 and is brought by the shaft 314 to move at the same time. The shaft 314 is connected to and driven by a motor 33 disposed below the powder filling mechanism 30. The motor 33 is controlled by a driving system including a coupler 34, an electromagnetic clutch 35, and a sensing plate 36 mounted on a lower portion of the shaft 314, as well as a sensor 37 provided near outer periphery of the sensing plate 36 at a predetermined position. Powder for filling into the capsules is stored in a powder tank 39 of the powder filling mechanism 30. An air cylinder 38 has a piston shaft 381, an outer end of which is eccentrically connected to a lower outer side of the powder tank 39, such that the whole powder tank 39 is driven by the air cylinder 38 to shift to a position above the capsule holding means 31 for filling powder into the capsules and return to its original position after the capsules are filled with powder. Before filling powder into capsules located in the capsule holding holes 32 on the capsule holding means 31, the upper part 311 of the capsule holding means 31 must be removed from the lower part 312, as shown in FIG. 5, to expose containers of the capsules located in the small-diameter lower holes 322 on the lower part 312 of the capsule holding means 32. After the containers of the capsules in the lower part 312 are filled with powder, the upper part 311 are assembled to the lower part 312 in the assembling mechanism 40.

Figure 6:
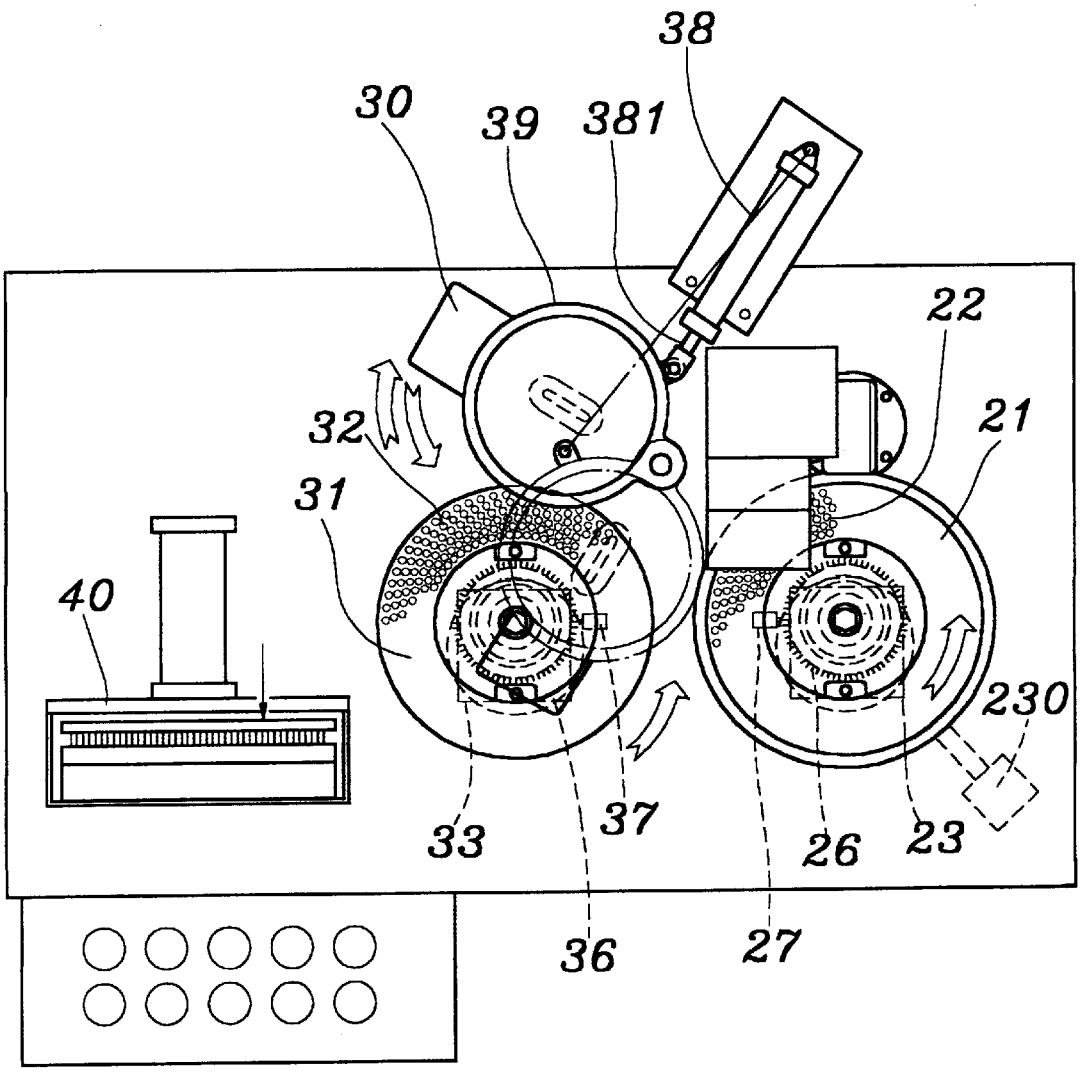
FIG. 6 is a top plan view showing the operation of the capsule filling apparatus of FIG. 3.

According to the capsule filling mechanism 20 shown in FIGS. 4, 5 and 6, the separation of the cap from the container of each empty capsule positioned in the capsule holding holes 22 through vacuum suction is controlled by the electromagnetic clutch 25 and the locating means 28. Therefore, the separation of the caps from the containers of the capsules can be more effectively and accurately performed. And, with the driving motor 33, the coupler 314, and the clutch 35, as well as the sensing plate 36 and the sensor 37, the powder filling mechanism 30 can be more precisely controlled in terms of its revolutions per second and the dispensed amount of powder to each capsule. With the locating means 28, a starting point of rotation of the capsule holding means can be accurately detected to effectively control correct amount of powder to be filled into the capsules. Moreover, with the air cylinder 38 which is incorporated in an existed electrical control system of the capsule filling apparatus, the travel of the powder tank 39 can be effectively controlled to further ensure precise dispensing and filling of correct powder amount to each capsule. In brief, the above-described arrangements in the present invention enable highly efficient production and eliminate drawbacks of insufficient or excessive filling of powder into capsules as found in the conventional manually-operated capsule filling apparatus.

What is claimed is:

1. A capsule filling apparatus comprising a capsule positioning mechanism, a powder filling mechanism, and an assembling mechanism;

said capsule positioning mechanism including a capsule holding means which is formed form an upper part and a lower part, said upper part being removably disposed on said lower part while said lower part is located in a seat, a plurality of capsule holding holes for each holding a capsule therein being formed on said capsule holding means and each including a large-diameter upper hole and a small-diameter lower hole respectively located in said upper part and said lower part of said capsule holding means, a suction hole being provided at a bottom of each said small-diameter lower hole to communicate with a suction pipe leading to an external suction source; said lower part of said capsule holding means in said seat rotating synchronously along with a shaft which is driven to rotate by a motor disposed below said seat, a driving system including a coupler, an electromagnetic clutch, and a sensing plate connected to said shaft below said capsule holding means and a sensor located near outer periphery of said sensing plate assisting said motor in controlling rotation of said shaft and accordingly said lower part of said capsule holding means, said sensing plate being provided with a plurality of sensing points according to number of capsule holding holes on said capsule holding means, and locating means being provided below said seat;

said powder filling mechanism including a capsule holding means and a driving system the same as that included in said capsule positioning mechanism, and a powder tank connected to an air cylinder, said air cylinder having a piston shaft eccentrically connected at an outer end to a lower outer side of said powder tank, so that said powder tank is driven by said air cylinder under control to move to or away from a position above said capsule holding means; and said assembling mechanism being adapted for assembling said upper part and said lower part of said capsule holding means after capsules positioned in said lower part having been filled with powder in said powder filling mechanism and moved to said assembling mechanism.

* * * * *